US011391415B1

(12) United States Patent
Li et al.

(10) Patent No.: US 11,391,415 B1
(45) Date of Patent: Jul. 19, 2022

(54) METHOD FOR MINIMIZING POWER DEMAND FOR HYDROGEN REFUELING STATION

(71) Applicants: China Energy Investment Corporation Limited, Beijing (CN); National Institute of Clean-and-Low-Carbon Energy, Beijing (CN)

(72) Inventors: Xianming Li, Orefield, PA (US); Anthony Ku, Fremont, CA (US); Kenneth William Kratschmar, Vancouver (CA); Jerad Allen Stager, Richmond, CA (US); Edward Youn, Pacific Grove, CA (US)

(73) Assignees: China Energy Investment Corporation Limited, Beijing (CN); National Institute of Clean-and-Low-Carbon Energy, Beijing (CN)

( * ) Notice: Subject to any disclaimer, the term of this patent is extended or adjusted under 35 U.S.C. 154(b) by 0 days.

(21) Appl. No.: 17/136,070

(22) Filed: Dec. 29, 2020

(51) Int. Cl.
*F17C 5/00* (2006.01)
*F17C 5/06* (2006.01)
*F17C 5/04* (2006.01)

(52) U.S. Cl.
CPC ..... *F17C 5/007* (2013.01); *F17C 5/04* (2013.01); *F17C 5/06* (2013.01);
(Continued)

(58) Field of Classification Search
CPC ..... F17C 2227/0142; F17C 2250/032; F17C 2250/0636; F17C 13/02; F17C 2201/0109;
(Continued)

(56) References Cited

U.S. PATENT DOCUMENTS 6,354,088 B1 * 3/2002 Emmer ..... F17C 5/007 141/82
6,810,924 B2 11/2004 White
(Continued)

FOREIGN PATENT DOCUMENTS

JP 2012167767 A 9/2012

OTHER PUBLICATIONS

Society of Automotive Engineers (SAE) International Surface Vehicle Technical Information Report (J2601, Mar. 2010) (Year: 2010).*
(Continued)

*Primary Examiner* — Timothy P. Kelly
*Assistant Examiner* — Christopher M Afful
(74) *Attorney, Agent, or Firm* — Calfee Halter & Griswold LLP

(57) ABSTRACT

A direct fueling station and a method of refueling are provided. The station includes an insulated tank for storing a liquefied fuel, a pump, at least a heat exchanger, a control unit, a dispenser including a flow meter, a flow control device, and at least one sensor for testing pressure and/or temperature. The heat exchanger converts liquefied fuel from pump into a gaseous fuel, which is added into an onboard fuel tank in a vehicle. The control unit includes one or more programs used to coordinate with the pump, the flow meter, the flow control device, and/or the sensor(s) so as to control a refueling method. A peak electrical power requirement is less than that determined by the product of a rated volumetric flow rate of the pump and a rated pumping pressure adequate for a fill pressure of the vehicle. A computer implemented system having the program(s) is also provided.

18 Claims, 9 Drawing Sheets

(52) U.S. Cl.
CPC ..... *F17C 2221/012* (2013.01); *F17C 2223/0161* (2013.01); *F17C 2225/0123* (2013.01); *F17C 2225/03* (2013.01); *F17C 2227/0142* (2013.01); *F17C 2250/032* (2013.01); *F17C 2250/043* (2013.01); *F17C 2250/0636* (2013.01)

(58) Field of Classification Search
CPC ..... F17C 2201/054; F17C 2203/0604; F17C 2203/0619; F17C 2203/0624; F17C 2221/012; F17C 2221/033; F17C 2223/0123; F17C 2223/0153; F17C 2223/0161; F17C 2223/036; F17C 2225/0123; F17C 2225/036; F17C 2250/043; F17C 2250/0439; F17C 2250/0443; F17C 2250/0491; F17C 2250/0495; F17C 2250/0631; F17C 2250/0694; F17C 2260/022; F17C 2260/023; F17C 2260/025; F17C 2260/026; F17C 2265/065; F17C 2270/0139; F17C 2270/0168; F17C 2270/0176; F17C 5/007; F17C 5/06; F17C 5/04; F17C 2225/03; Y02E 60/32; Y02E 60/321
USPC ..... 141/4
See application file for complete search history.

(56) References Cited

U.S. PATENT DOCUMENTS

| | | | | |
|---|---|---|---|---|
| 7,222,647 | B2 | 5/2007 | Bingham et al. | |
| 2014/0290790 | A1* | 10/2014 | Mathison | F17C 5/007 141/4 |
| 2016/0273713 | A1 | 9/2016 | Lee | |
| 2020/0095113 | A1 | 3/2020 | Crispel et al. | |
| 2020/0156923 | A1 | 5/2020 | Li et al. | |
| 2020/0158288 | A1 | 5/2020 | Li et al. | |

OTHER PUBLICATIONS

Genereaux et al., "Transport and Storage of Fluids," Section 6, Perry's Chemical Engineering Handbook, 6th Edition, 1984.

S. Moran, , "Pump Sizing: Bridiging the Gap Between Theory and Practice", Chemical Engineering Progress, American Institute of Chemical Engineers (AIChE), Dec. 2016.

Lemmon et al., NIST Reference Fluid Thermodynamic and Transport Properties—REFPROP, Jun. 4, 2018, NIST Standard Reference Database 23, National Institute of Standards and Technology, US DOE.

European Patent Office, Extended European Search Report dated Aug. 9, 2021, for corresponding European Patent Application No. 21156634.4.

* cited by examiner

METHOD FOR MINIMIZING POWER DEMAND FOR HYDROGEN REFUELING STATION

PRIORITY CLAIM AND CROSS-REFERENCE

None.

FIELD OF THE INVENTION

The disclosure relates to methods and systems for fuel transfer and pressurized gas dispensing generally. More particularly, the disclosed subject matter relates to a system or a hydrogen fueling station and a method for fueling or refueling gaseous hydrogen to vehicles, tanks, or devices.

BACKGROUND

Most of the motor vehicles are powered by internal combustion engines with fossil fuels. Due to limited supply and adverse environmental effects associated with burning these fuels, vehicles are now being developed that are powered by alternative environmentally friendly fuels like hydrogen. The fuel cells can be used to produce electric power by electrochemically reacting hydrogen fuel with an oxidant such as air. Other hydrogen-powered vehicles can be powered by combustion of hydrogen. Fueling or refueling hydrogen to fuel cell vehicles (FCV) and other hydrogen-powered vehicles presents different challenges from adding petroleum-based fuels like gasoline into a vehicle.

Current hydrogen refueling stations employ a large cascade storage system and a small compressor to manage short-term large flow demand. The cascade storage system requires large capital investment and takes a large footprint, yet is limited in the number of vehicles that can be filled consecutively. For large capacity stations such as a bus fleet, high-flow direct fill capability is required.

SUMMARY OF THE INVENTION

The present disclosure provides a direct-fill (or direct) fueling station or system, a method of designing or operating a direct-fill fueling station, and a method of refueling a vehicle.

In accordance with some embodiments, such a direct-fill fueling station comprises an insulated tank configured to store a liquefied fuel comprising a liquid phase and a gaseous phase therein, and a pump configured to pump out the liquefied fuel from the insulated tank. The station further includes at least a heat exchanger connected with the pump, and a dispensing unit. The dispensing unit includes a flow meter, a flow control device, and at least one sensor for testing pressure and/or temperature, which are connected with the heat exchanger. The pump is configured to provide a portion of the liquefied fuel. The at least one heat exchanger converts the portion of the liquefied fuel into a gaseous fuel (a compressed gas) at a desired pressure and temperature. The dispensing unit is configured to dispense the gaseous fuel into an onboard fuel tank in a vehicle. The heat exchanger is configured to vaporize the liquefied fuel from the pump before it is dispensed to the vehicle storage tank as a compressed gas.

In some embodiments, the station further includes a control unit comprising one or more processors and at least one tangible, non-transitory machine readable medium encoded with one or more programs to be executed by the one or more processors. The control unit is configured to coordinate with the pump, the flow meter, the flow control device, and the at least one sensor so as to control a method of fueling the vehicle. The electrical power demand of the station is less than that determined by the product of a rated volumetric flow rate of the pump and a rated pumping pressure adequate for a fill pressure of the vehicle. In some embodiments, the pump has a total electrical power demand being at least 90% of the electrical power demand of the station during operation. The pump may be a reciprocating pump. The liquefied fuel comprises liquid hydrogen, and is liquid hydrogen in some embodiments.

In some embodiments, the electrical power demand is at least a percentage such as 15%, 20%, or 25% less than the product of the rated volumetric flow rate of the pump and the rated pumping pressure adequate for the fill pressure of the vehicle.

In some embodiments, the control unit is configured to set a pressure ramp profile or a mass flow rate profile of the gaseous fuel added to the onboard fuel tank so as to control the electrical power demand of the station. The control unit can also be configured to output the pressure ramp profile or the mass flow rate profile for fueling a vehicle, and status information including the state of charge (SOC) during a fill process.

For example, the control unit is configured to control the electrical power demand of the station by increasing the flow rate of the liquefied fuel delivered by the pump (which determines the flow rate of the gaseous fuel dispensed to the onboard fuel tank) at a beginning of a fill process at a low pressure, then reducing the flow rate near an end of the fill process at a high pressure. The instantaneous power requirement is substantially constant during the fill process.

In another aspect, the present disclosure also provides a method of sizing and/or operating a direct-fill fueling station. The method of sizing can be used at the design stage in some embodiments. Such a method comprises steps as described herein. A liquefied fuel comprising a liquid phase and a gaseous phase is provided in an insulated tank in a direct-fill fueling station. The direct-fill station further comprises a pump, at least one heat exchanger connected with the pump, and a dispensing unit including a flow meter, a flow control device, and at least one sensor for testing pressure and/or temperature, which are connected with the heat exchanger. Such a method further comprises steps of coupling a vehicle having an onboard fuel tank with the flow control device and the at least one sensor, converting the portion of the liquefied fuel from the pump to a gaseous fuel in the at least one heat exchanger, and adding the gaseous fuel to the onboard fuel tank in the vehicle using the dispensing unit. The heat exchanger converts the liquefied fuel from the pump into the gaseous fuel.

In some embodiments, the method further comprises a step of determining and/or controlling an electrical power demand of the station using a control unit. The control unit comprises one or more processors and at least one tangible, non-transitory machine readable medium encoded with one or more programs to be executed by the one or more processors, to coordinate with the pump, the flow meter, the flow control device, and the at least one sensor. As a result, the electrical power demand of the station is less than that determined by the product of a rated volumetric flow rate of the pump and a rated pumping pressure adequate for a fill pressure of the vehicle.

In some embodiments, the total electrical power demand of the pump is at least 90% of the electrical power demand of the station during a filling cycle. The pump is a reciprocating pump. The liquefied fuel comprises or is liquid hydrogen. In some embodiments, the electrical power demand is at least a percentage such as 15%, 20%, or 25% less than the product of the rated volumetric flow rate of the pump and the rated pumping pressure adequate for the fill pressure of the vehicle.

In some embodiments, the electrical power demand of the station is determined and controlled by setting up a pressure ramp profile or a mass flow rate profile of the gaseous fuel added to the onboard fuel tank. For example, the electrical power demand of the station is determined and controlled by increasing the flow rate of the gaseous fuel added to the onboard tank (i.e. also the liquefied fuel from the pump) at a beginning of a fill process at a low pressure, then reducing the flow rate near an end of the fill process at a high pressure. The instantaneous power requirement is substantially constant during the fill process.

In some embodiments, the step of determining and controlling the electrical power demand of the station using the control unit comprises the following steps:

inputting initial tank pressure, initial tank temperature, volume of the insulated tank, a desired fill time, a target pressure or a target state of charge (SOC);

calculating initial density, total mass, and internal energy of the gaseous fuel in the onboard fuel tank;

setting a pressure ramp profile to achieve the targeted fill time;

setting a desired fill temperature at a nozzle;

setting the pump discharge pressure sufficiently high to overcome a system pressure loss from pump discharge to the nozzle to achieve a desired nozzle pressure;

calculating enthalpy of the gaseous fuel based on the desired fill temperature at the nozzle and the pump discharge pressure;

advancing a time interval;

applying mass and energy balance to the onboard fuel tank after the time interval is advanced, optionally with consideration of a heat loss;

determining an added mass of the gaseous fuel added into the onboard fuel tank; and evaluating instantaneous electrical power demand and state of charge (SOC), optionally repeating the step of advancing a time interval if needed so as to reach the target SOC.

In some embodiments, the step of determining and controlling the electrical power demand of the station using the control unit further comprises adjusting the pressure ramp profile so that the electrical power demand of the station is substantially constant during the fill process, while the target fill time and target SOC are achieved.

In some embodiments, a peak electrical power demand of the station is determined as a rated power requirement through simulation at a stage of designing a station.

In some embodiments, the method further comprises outputting the pressure ramp profile or the mass flow rate profile of the gaseous fuel on which a vehicle is refueled.

In another aspect, the present disclosure also provides the control unit or a computer implemented system as described herein. The control unit or system comprises at least one tangible, non-transitory machine readable medium encoded with one or more programs for performing the methods disclosed herein. The control unit is used in a direct-fill fueling station for refueling a vehicle with gaseous fuel such as hydrogen.

The station or system provided herein can be a high-flow direct fill system with large capacity stations for fueling gaseous fuel such as hydrogen, with minimal and stable electrical power demand. It can be used for fueling or refueling a vehicle efficiently and fast.

BRIEF DESCRIPTION OF THE DRAWINGS

The present disclosure is best understood from the following detailed description when read in conjunction with the accompanying drawings. It is emphasized that, according to common practice, the various features of the drawings are not necessarily to scale. On the contrary, the dimensions of the various features are arbitrarily expanded or reduced for clarity. Like reference numerals denote like features throughout specification and drawings.

In FIGS. 6 and 8, the numeral values of instantaneous motor power demand are shown in the right y-axis. In FIGS. 7 and 9, the numeral values of the state of charge are shown in the left y-axis in percentage up to 100.

DETAILED DESCRIPTION

Figure 1:
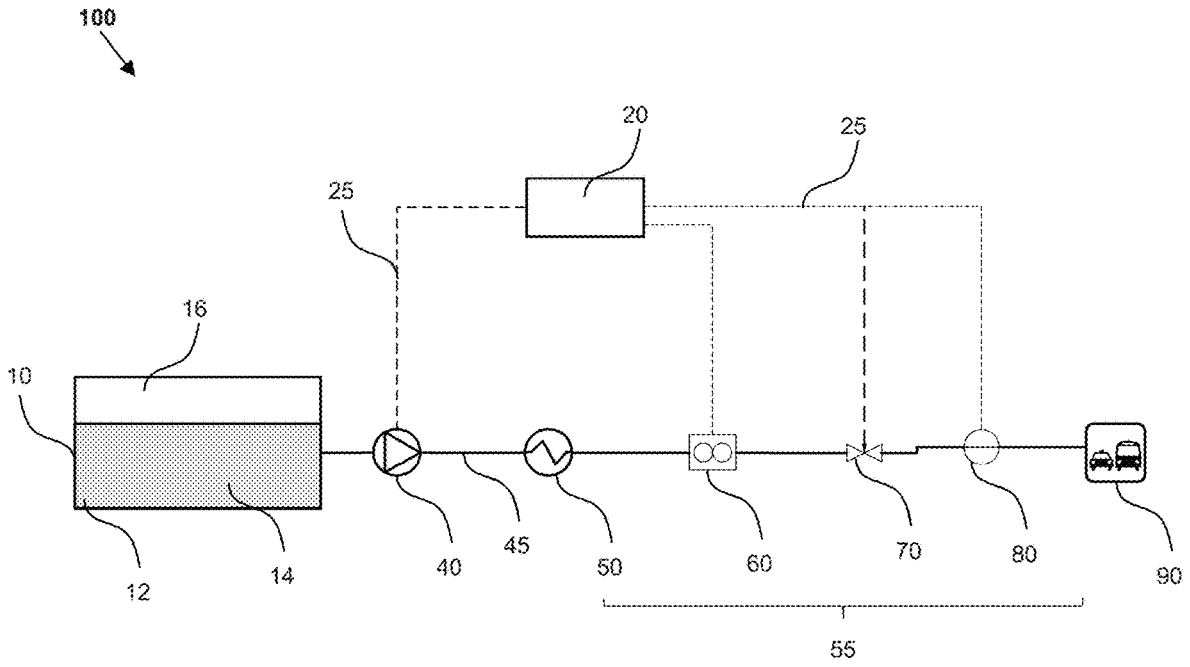
FIG. 1 is a block diagram illustrating an exemplary system comprising a control unit in a direct-fill liquid hydrogen refueling station in accordance with some embodiments.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

For purposes of the description hereinafter, it is to be understood that the embodiments described below may assume alternative variations and embodiments. It is also to be understood that the specific articles, compositions, and/or processes described herein are exemplary and should not be considered as limiting.

In the present disclosure the singular forms "a," "an," and "the" include the plural reference, and reference to a particular numerical value includes at least that particular value, unless the context clearly indicates otherwise. When values are expressed as approximations, by use of the antecedent "about," it will be understood that the particular value forms another embodiment. As used herein, "about X" (where X is a numerical value) preferably refers to +10% of the recited value, inclusive. For example, the phrase "about 8" preferably refers to a value of 7.2 to 8.8, inclusive. Where present, all ranges are inclusive and combinable. For example, when a range of "1 to 5" is recited, the recited range should be construed as including ranges "1 to 4", "1 to 3", "1-2", "1-2 & 4-5", "1-3 & 5", "2-5", and the like. In addition, when a list of alternatives is positively provided, such listing can be interpreted to mean that any of the alternatives may be excluded, e.g., by a negative limitation in the claims. For example, when a range of "1 to 5" is recited, the recited range may be construed as including situations whereby any of 1, 2, 3, 4, or 5 are negatively excluded; thus, a recitation of "1 to 5" may be construed as "1 and 3-5, but not 2", or simply "wherein 2 is not included." It is intended that any component, element, attribute, or step that is positively recited herein may be explicitly excluded in the claims, whether such components, elements, attributes, or steps are listed as alternatives or whether they are recited in isolation.

Unless it is expressly stated otherwise, the term "substantially constant" or "substantially the same" used herein will be understood to encompass a parameter with a fluctuation in a suitable range, for example, with ±10% or +15% fluctuation of the parameter. In some embodiments, the range of fluctuation is within ±10%.

Unless expressly indicated otherwise, references to "direct-fill" (or "direct") made herein will be understood to refer to a continuous operation of a fueling or refueling process from a storage tank at a fueling station to a storage tank in a vehicle. For example, in a direct-fill system or process, liquid hydrogen can be taken from a storage tank, vaporized, and directly dispensed into a receiving tank in a vehicle. Gaseous hydrogen from the liquid state continuously flows into the receiving tank. Hydrogen is stored in the form of compressed gas in the receiving tank in a vehicle. The terms "direct-fill" and "direct" are used interchangeably with respect to a fueling or refueling process. In the existing technologies, there is an intermediate cascade storage step, where compressed gaseous hydrogen is stored after vaporization, but before dispensed into a receiving tank of a vehicle.

Unless expressly indicated otherwise, a liquefied fuel such as hydrogen is stored in a storage tank, and pumped out using a pump in liquid form. The liquefied fuel is vaporized to become a gaseous fuel in a heat exchanger. The fuel between the pump and the heat exchanger may be in a supercritical state. The gaseous fuel is dispensed into a receiving tank in a vehicle.

Unless expressly indicated otherwise, references to "fill pressure" made herein will be understood to refer to the pressure inside the vehicle storage tank (i.e. an onboard fuel tank), and references to "pumping pressure" made herein refers to the discharge pressure of the pump for fuel such as hydrogen. The difference between pumping pressure and fill pressure is the pressure drop across the piping and additional equipment such as heat exchangers and flow regulator in the dispensing system. Nozzle pressure is essentially equal to the fill pressure with only minor pressure losses downstream the regulator. Sometimes with zero or negligible pressure drop, the fill pressure and pumping pressure are approximately the same.

Unless expressly indicated otherwise, "state of charge" (SOC) described herein is defined as a ratio of actual density of $H_2$ in the vehicle storage tank to that at 350 bar (35 MPa) and 15° C. Such a ratio can be percentage in percentage (%).

In the present disclosure, the terms "fueling" and "refueling" are used interchangeably. The terms "power demand" and "power requirement" are used interchangeably.

The present disclosure provides a direct-fill fueling station or system, a method of designing or operating a direct-fill fueling station, and a method of refueling a vehicle. The present disclosure also provides the control unit or system and the related programs as described herein.

Figure 2:
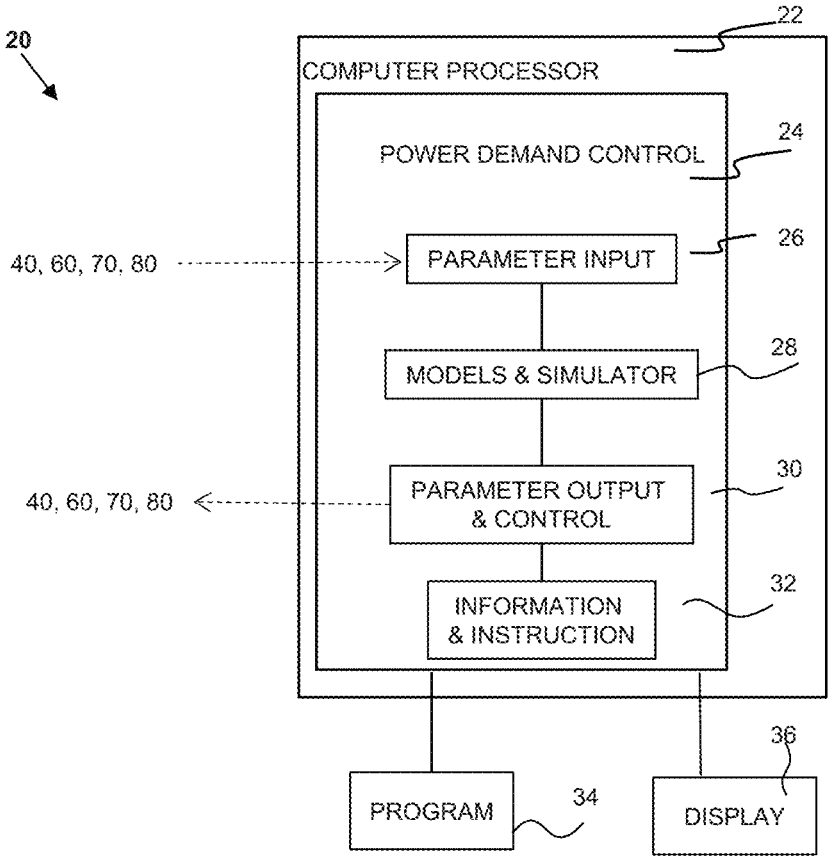
FIG. 2 is a block diagram illustrating an exemplary control unit or computer implemented unit comprising one or more processor and at least one tangible, non-transitory machine readable medium encoded with one or more programs, for controlling power demand and controlling a refueling process in accordance with some embodiments.
Figure 3:
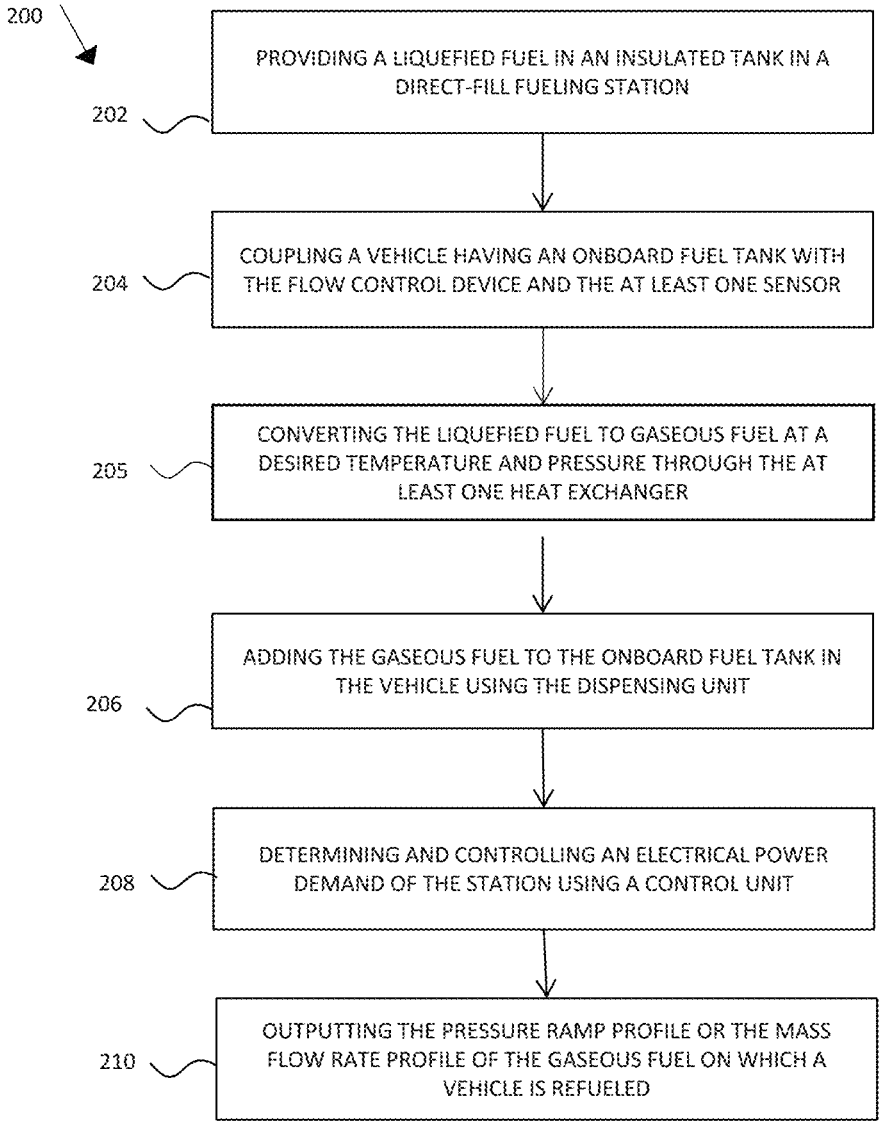
FIG. 3 is a flow chart illustrating an exemplary method for controlling and minimizing the power demand in a direct-fill liquid hydrogen refueling station in accordance with some embodiments.
Figure 4:
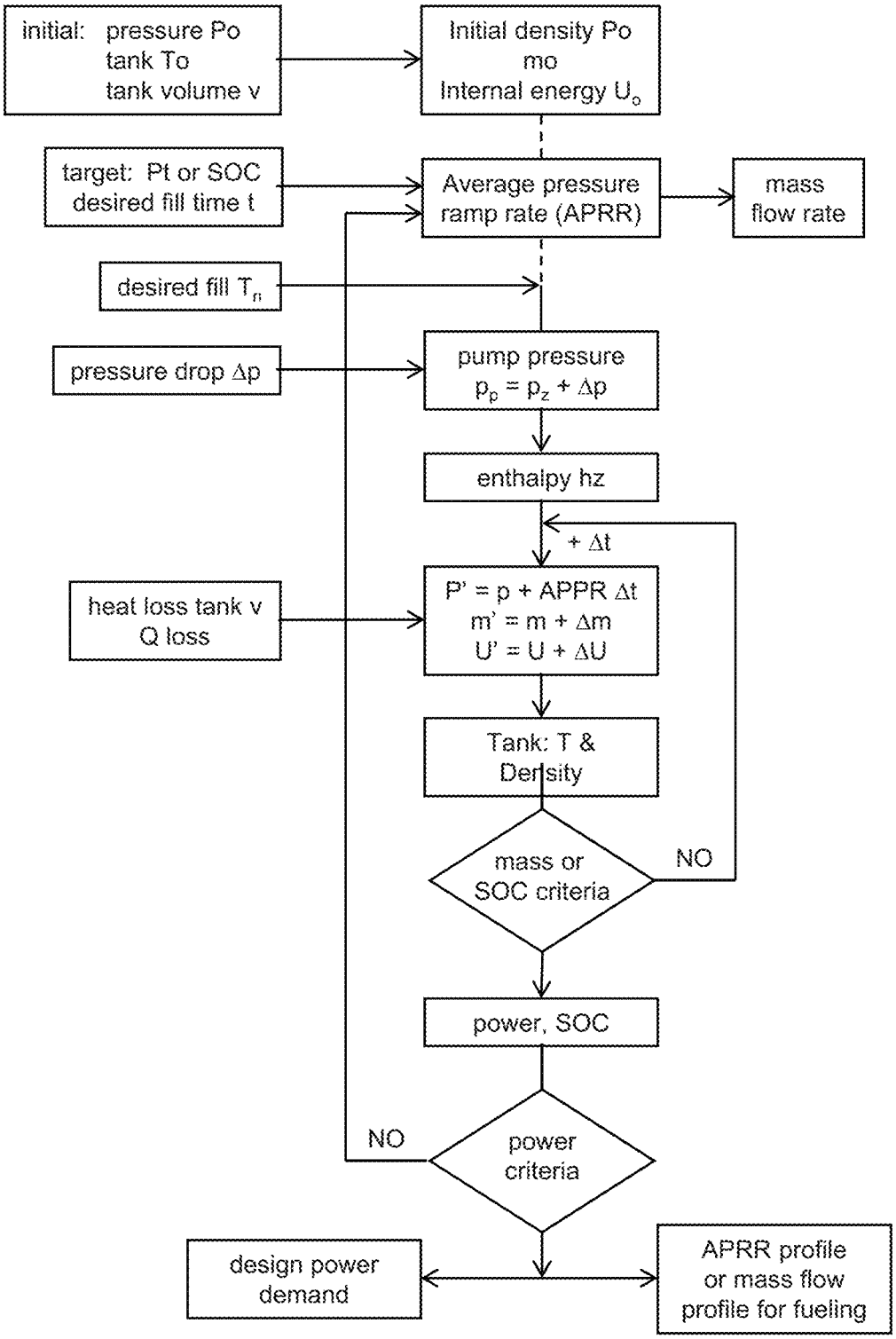
FIG. 4 is a flow chart illustrating a program for controlling and minimizing the power demand and controlling a refueling process in accordance with some embodiments.

In FIGS. 1-2, like items are indicated by like reference numerals, and for brevity, descriptions of the structure, provided above with reference to the preceding figures, are not repeated. The methods described in FIGS. 3-4 are described with reference to the exemplary structure described in FIGS. 1-2.

A high-flow direct fill system is needed for large capacity stations for fueling hydrogen. Direct-fill capability can greatly reduce or eliminate the need for cascade storage by enabling continuous flow of hydrogen from the station storage tank to the vehicle storage tanks. Refueling stations capable of dispensing hydrogen to vehicles comprise equipment that draw electrical loads during operation. The electrical power requirement depends on the station design, with the electrical connection for the fueling dispensing system sized in a manner to accommodate peak electrical power. In hydrogen stations with direct-fill technology the energy requirement is determined by the product of the volumetric flow rate and the fill pressure.

The peak power demand for such a high-flow direct fill system is or is proportional to the product of volumetric flow rate and the fill pressure. For example, an approximate power rating for a pump needed can be calculated using Equation (I):

$$W=Q\Delta P/\eta,$$

wherein W is the pump power (kW), Q is the flow rate ($m^3$/hr), ΔP is the difference between the inlet pressure and the fill pressure (p), and η (%) is the pump efficiency. In general the inlet pressure before the pump is very low and can be negligible in some embodiments. Therefore, the power demand is or is proportional to the product of volumetric flow rate (Q) and the fill pressure (p). This fill pressure (p) is the pump pressure when there is no pressure drop.

Direct-full technologies for refueling station offer the ability to achieve high flow. A reciprocating liquid hydrogen pump with high flow, which is used in some embodiments, can provide the required high-flow direct fill. With reciprocating machines, although the average power requirement over a typical fueling cycle is approximately 25% of the instantaneous peak, it is the peak power that sets the electrical requirement. High peak power can also result in high demand charges, driving up the cost of dispensed $H_2$. As described above, the peak power demand is the product of rated volumetric flow rate and the maximum pumping pressure, which can be hundreds of kilowatts, thus presents challenges in obtaining power supply. The power demand for a high-flow direct fill system can be as high as hundreds of kilowatts, thus presents challenges in obtaining a suitable power supply.

The present disclosure provides a station or system and a method to tailoring the peak power demand while meeting the flow, pressure and fill time requirements in such high-flow direct fill system for refueling with stored liquid hydrogen. In accordance with some embodiments, the present disclosure provides a method of operating direct-fill refueling stations, wherein the peak energy requirement (power demand) is less than the product of the volumetric flow rate and the fill pressure, or is less than that calculated value using Equation (I) based on the product of the volumetric flow rate and the fill pressure. In some embodiments, a method to operate the refueling a vehicle in a direct-fill fueling station or system and such a fueling station or system are provided.

Referring to FIG. 1, an exemplary direct-fill fueling station 100 is provided in accordance with some embodiments. The direct-fill fueling station 100 comprises an insulated tank 10, a control unit or system 20, a pump 40, at least one heat exchanger 50, a flow meter 60, a flow control device 70, and at least one sensor 80 for testing pressure and/or temperature. In some embodiments, the flow meter 60, the flow control device 70, the at least one sensor 80, and optionally the heat exchanger 50 can be referred as a dispensing unit 55. The flow control device 70 and at least one sensor 80 can be a part of a nozzle configured into or in contact with an onboard tank of a vehicle 90.

The insulated tank 10 is configured to store a liquefied fuel 12 comprising a liquid phase 14 and a gaseous phase 16 therein. The pump 40 is configured to pump out the liquefied fuel 12 from the insulated tank. The at least a heat exchanger 50 is fluidly coupled or connected with the pump 40. The flow meter 60, a flow control device 70, and at least one sensor 80 for testing pressure and/or temperature are fluidly coupled or connected with each other and with the heat exchanger 50. The components fluidly coupled or connected together through pipes 45.

The pump 40 is configured to provide a portion of the liquefied fuel 12. The at least one heat exchanger 50 converts the portion of the liquefied fuel 12 into a gaseous fuel (a compressed gas) at a desired pressure and temperature. The dispensing unit 55 is configured to dispense the gaseous fuel into an onboard fuel tank (or called a vehicle storage vessel) in a vehicle 90. The heat exchanger 50 is configured to vaporize the liquefied fuel 12 from the pump 40 before it is dispensed to the vehicle storage tank as a compressed gas. In some embodiments, the flow control device 70 and the at least one sensor 80 may be combined into a single nozzle. The station may include other apparatus such as a compressor (not shown).

The exemplary station 100 further includes a control unit 20, which comprises one or more processors and at least one tangible, non-transitory machine readable medium encoded with one or more programs to be executed by the one or more processors as described below in FIG. 2. The control unit 20 may be connected with the pump 40, the flow meter 60, the flow control device 70, and the at least one sensor 80 through electrical connection or wireless connection 25. The connection 25 in dotted lines is understood as wireless or electrical connections. The control unit 20 is configured to coordinate with the pump 40, the flow meter 60, the flow control device 70, and the at least one sensor 80 so as to control a method of fueling the vehicle 90.

The control unit 20 may be electronically connected with other components, and such electronic connections may be through wire connection, wireless connection, and may include cloud based connection. The control unit 20 and other component can be also connected to an industrial control such as a programmable logic controller (PLC), which is supervised by a supervisory control and data acquisition (SCADA) computer with a human-machine interface (HMI).

The electrical power demand of the exemplary station 100 is less than that determined by the product of a rated volumetric flow rate of the pump 40 and a rated pumping pressure adequate for a fill pressure of the vehicle. In some embodiments, the pump 40 has a total electrical power demand being at least 90% of the electrical power demand of the station 10 during operation. The liquefied fuel is liquid hydrogen, and gaseous hydrogen is added into the tank of the vehicle 90 in some embodiments.

The pump 40 may be any suitable pump, for example, a reciprocating pump, which is for a direct fill system. A reciprocating pump is a class of positive-displacement pumps. Examples of a reciprocating pump include, but are not limited to, a piston pump, a plunger pump, and a diaphragm pump.

The station or system uses a peak electrical load less than the product of the maximum fill rate and maximum pumping pressure. It is not obvious how such large peak power demand can be reduced while meeting the fueling flow, pressure and fill time requirements. The enabling feature to overcome this limitation is the variable operation during the fill procedure.

In some embodiments, a reciprocating pump is operated at variable piston speeds and pumping pressure to meet constraints around the overall or average fill rate and final fill pressure, while simultaneously requiring peak electrical loads less than the product of the maximum instantaneous fill rate during the cycle and the maximum pumping pressure. In some embodiments, the electrical power demand is at least a percentage such as 15%, 20%, or 25% less than the product of the rated volumetric flow rate of the pump 40 and the rated pumping pressure adequate for the fill pressure of the vehicle. In some embodiments, such a percentage may not be fixed. For example, the saving in the power demand may be by at least 15%, then at least 20% and then at least 25%.

Referring to FIG. 2, an exemplary control unit or system 20 is illustrated. Such a control unit 20 includes one or more processors 22, and at least one tangible, non-transitory machine readable medium encoded with one or more programs 34, to be executed by the one or more processors, to perform the functions or the method as described above. The processor(s) 22 may include a power demand control 24, which includes a parameter input module 26, models and simulator 28, a parameter output and control module 30, and information and instruction module 32. The parameter input and output modules 26 and 30 coordinate with the pump 40, the flow meter 60, the flow control device 70, and the at least one sensor 80. Together with the one or more programs 34, the models and simulator 28 is configured to perform a simulation based on the input parameters to provide information and instruction to the information and instruction module 32. The processors 22 may be connected with one or more displays 36 for displaying the information and instructions from module 32 and to an operator.

In some embodiments, the control unit 20 is configured to set a pressure ramp profile or a mass flow rate profile of the gaseous fuel added to the onboard fuel tank so as to control the electrical power demand of the station 10. The control unit 20 can also be configured to output the pressure ramp profile or the mass flow rate profile for fueling a vehicle, and status information including the state of charge (SOC) during a fill process.

For example, as shown in Example 5, the control unit 20 is configured to control the electrical power demand of the station by increasing the flow rate of the gaseous fuel at a beginning of a fill process at a low pressure, then reducing the flow rate near an end of the fill process at a high pressure. The instantaneous power requirement is substantially constant during the fill process in some embodiments.

Referring to FIG. 3, an exemplary method 200 is used sizing and/or operating a direct-fill fueling station 100. The method of sizing can be used at the design stage in some embodiments. Such a method 200 comprises steps as described herein.

At step 202, a liquefied fuel 12 comprising a liquid phase and a gaseous phase is provided in an insulated tank 10 in a direct-fill fueling station 100. As described above, the direct-fill station 100 further comprises a pump 40, at least one heat exchanger 50, a flow meter 60, a flow control device 70, and at least one sensor 80 for testing pressure and/or temperature.

At step 204, a vehicle 90 having an onboard fuel tank is coupled with the flow control device 70 and the at least one sensor 80.

At step 205, the portion of the liquefied fuel 12 from the pump 40 is converted into a gaseous fuel (a compressed gas) at a desired pressure and temperature using at least one heat exchanger 50.

At step 206, the gaseous fuel 12 is added to the onboard fuel tank in the vehicle 90 the dispensing unit pump 55.

At step 208, an electrical power demand of the station is determined and/or controlled using a control unit 20. The control unit 20 comprises one or more processors 20 and at least one tangible, non-transitory machine readable medium encoded with one or more programs 34 to be executed by the one or more processors 20. The control unit 20 coordinates with the pump 40, the flow meter 60, the flow control device 70, and the at least one sensor 80. As a result, the electrical power demand of the station 100 is less than that determined by the product of a rated volumetric flow rate of the pump 40 and a rated pumping pressure adequate for a fill pressure of the vehicle 90.

In some embodiments, the electrical power demand of the station 100 is determined and controlled by setting up a pressure ramp profile or a mass flow rate profile (or volumetric flow rate) of the gaseous fuel added to the onboard fuel tank. The volumetric flow rate of the liquefied fuel 12 though the pump 40 can be calculated from the mass flow rate of the gaseous fuel though the mass balance. For example, the electrical power demand of the station is determined and controlled by increasing the flow rate of the gaseous fuel into the vehicle tank (i.e. also the flow rate of the liquefied fuel from the pump) at a beginning of a fill process at a low pressure, then reducing the flow rate near an end of the fill process at a high pressure. The instantaneous power requirement is substantially constant during the fill process. The flow rate can be increased by increasing average pressure ramp rate (APRR) in some embodiments.

For another example, the pressure profile can be adjusted with a liner increase (see Example 1).

Referring to FIG. 4, in some embodiments, the step 208 of determining and controlling the electrical power demand of the station using the control unit comprises the following steps (as also illustrated in Example 1):

(a) Initial tank pressure (Po), initial tank temperature (To), volume of the insulated tank (V), a desired fill time, and/or a target pressure or a target state of charge (SOC) can be measured or input as input parameters. The conditions measured using sensor(s) 80 such as pressure and temperature are referred as "nozzle conditions."

(b) Based on the information above, initial density, total mass, and internal energy of the gaseous fuel in the onboard fuel tank can be calculated.

(c) A pressure ramp profile is set to achieve the targeted fill time. An average pressure ramp rate (APRR) can be calculated. The APRR can be also to calculate mass or volumetric flow rate, which can be controlled by the APRR. An increasing APRR provides an increasing flow rate.

(d) A desired fill temperature at a nozzle is set.

(e) The pump discharge pressure ($p_p$) sufficiently high to overcome a system pressure loss from pump discharge to the nozzle to achieve a desired nozzle pressure (pz) is set.

(f) Calculation of enthalpy (hz) of the gaseous fuel is performed based on the desired fill temperature at the nozzle and the pump discharge pressure.

(g) A time interval ($\Delta t$) is advanced.

(h) Mass and energy balance to the onboard fuel tank is applied after the time interval is advanced, optionally with consideration of a heat loss (Qloss).

(i) An added mass of the gaseous fuel added into the onboard fuel tank is determined.

(j) Instantaneous electrical power demand and state of charge (SOC) are calculated. Optionally, if the target mass or SOC is not met, the step of advancing a time interval is repeated so as to reach the target SOC or mass.

In some embodiments, in the step of determining and controlling the electrical power demand of the station using the control unit, if the power criteria is not met or not desired, the pressure ramp profile (or flow rate profile) of the gaseous fuel is adjusted by going back to step (c) so that the electrical power demand of the station is substantially constant during the fill process, while the target fill time and target SOC are achieved.

Figure 5:
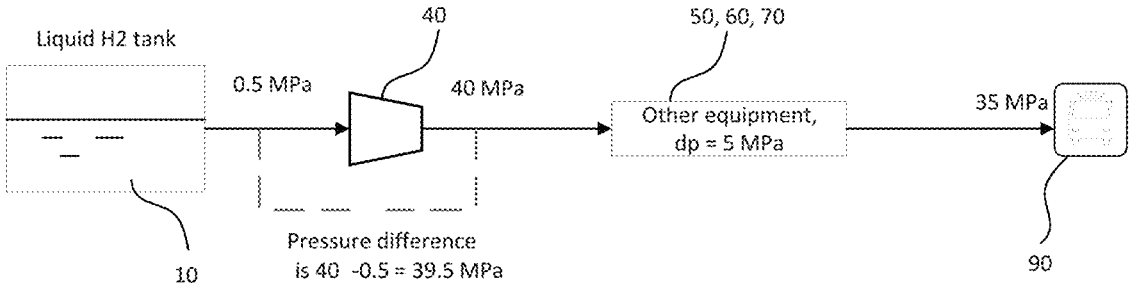
FIG. 5 shows an example illustrating the relationship of different pressure values.

As described above, the power demand W for the pump (in kW) is calculated based on is the volumetric flow rate Q (in $m^3$/hr) of the liquefied fuel, the difference $\Delta P$ between the inlet pressure and the pump pressure, and the pump efficiency q (%), which can be fixed (e.g., 70%, 80%, 90%, or 100%). The volumetric flow rate Q of the liquefied fuel 12 though the pump 40 can be calculated from the mass flow rate of the gaseous fuel though the mass balance. The pump pressure needed is also provided based on the needs. For example, for the illustration purpose only, FIG. 5 shows one example. The inlet pressure of the liquefied fuel 12 before the pump 40 is very low, for example, 0.5 MPa illustrated in FIG. 5. The fill pressure of the onboard tank of the vehicle 90 may be 35 MPa (i.e. 350 bar) based on the requirement. Between the pump 40 and the vehicle 90, there might be a pressure drop, for example, 5 MPa as illustrated in FIG. 5. Such a pressure drop may be caused by other components such as heat exchanger 50, flow meter 60 and flow control device 70. When the pressure drop is zero or negligible, the pump pressure and fill pressure are the same. Based on the pump pressure and the inlet pressure, the pressure difference needed in Equation (I) can be calculated. Therefore, the power demand at each time interval can be calculated.

In some embodiments, the method including the steps above can be used at a stage of designing a station 100. A peak electrical power demand (or requirement) of the station is determined as a rated power requirement through simulation. As described in FIG. 4, a curve of power demand including the peak power demand as the rated power requirement can be output from the exemplary control unit 200 in FIG. 2. The rated power requirement is the maximum of the instantaneous power demand during the simulated fill, which is less than the product of the maximum flow and the maximum discharge pressure of the pump. In some embodiments, the rated electrical power requirement is less than the product of the rated volumetric flow rate of the pump and the rated pumping pressure adequate for the vehicle fill pressure.

In some embodiments, the method 200 further comprises outputting the pressure ramp profile or the mass or volumetric flow rate profile of the gaseous fuel on which a vehicle is refueled. Such a profile can be selected by the control unit or by an operator for fueling a vehicle.

In some embodiments, the total electrical power demand of the pump 40 is at least 90% of the electrical power demand of the station during a filling cycle. The pump is a reciprocating pump. The liquefied fuel comprises or is liquid hydrogen, and gaseous hydrogen is added into a vehicle. In some embodiments, the electrical power demand is at least 25% less than the product of the rated volumetric flow rate of the pump 40 and the rated pumping pressure adequate for the fill pressure of the vehicle 90.

In some embodiments, the reciprocating pump is operated in a manner that delivers $H_2$ at a non-constant mass flow rate during the filling cycle. The peak mass flow rate from the pump exceeds the rated maximum mass flow rate of the pump during at least part of the filling cycle. The average flow rate during the first part of the fill cycle (by time) is higher than average fill rate for the entire cycle.

In some embodiments, a simulation of the entire fueling cycle under different possible scenarios in the present disclosure shows that peak flow and peak pressure never coincide. They not only occur at different times during the fill cycle, but also trend in opposite directions. When peak flow is required, the pressure against which the hydrogen pump operates is low, and vice versa.

Furthermore, piston seal wear in the reciprocating liquid hydrogen pump is proportional to pump discharge pressure and piston velocity. At low discharge pressure, the piston velocity can be increased beyond design level while maintaining equal or better seal wear, thus increasing pump flow at low pressure to allow lower flow rate at high pressure for a lower peak power demand without sacrificing seal life.

So both the power demand and the piston seal wear are controlled by adjusting and the pump pressure and flow rate. The two-fold considerations are combined to provide a method to reduce the peak power demand while meeting fueling requirements. The instantaneous electrical load needed to operate the reciprocating pump during the filling cycle is the product of the instantaneous flow rate and the instantons pumping pressure. The instantaneous electrical load or the maximum power needed is less than the product of the overall or average design flow rate and design pumping pressure. This means the peak electrical load is less than said product, and that the electrical supply and electrical drive equipment to the refueling system can be sized at a smaller level than practiced in the existing technologies.

The present disclosure also provides the control unit or a computer implemented system 20 as described herein. The control unit or system 20 comprises at least one tangible, non-transitory machine readable medium encoded with one or more programs 34 for performing the methods disclosed herein. The control unit 20 is used in a direct-fill fueling station for refueling a vehicle with fuel such as hydrogen.

The beneficial result of the invention is that the peak electrical load required by the system during a fill cycle is less than the electrical load indicated by the product of the average fill rate and pumping pressure. This reduces the size of the electrical load that must be provided to the station to allow operation as well as peak electrical demand charges.

In the station or system provided in the present disclosure, with the use of a reciprocating pump, the peak flow rate and peak pressure do not coincide during a filling cycle. In some embodiments, the pump is operated in such a way that that the flow rate is higher earlier in the filling cycle. The peak electrical load for the pump (and the overall system) is reduced at levels below the theoretical estimate provided by the product of the average fill rate and fill pressure.

The station or system provided herein can be a high-flow direct fill system with large capacity stations for fueling fuel such as hydrogen, with minimal and stable electrical power demand. It can be used for fueling or refueling a vehicle efficiently and fast.

EXAMPLES

A direct-fill system including a reciprocating pump as described above was used for refueling hydrogen for vehicles. Unless expressly indicated otherwise, references to a pressure value with a unit such as bar, bar(g) and barg are understood as gauge pressure, which is a pressure in bars above ambient or atmospheric pressure. Pump rated flow is equivalent to design pump flow.

The Reference Fluid Thermodynamic and Transport Properties (REFPROP) data package from National Institute of Standard and Technology (NIST) was used in the examples described below. REFPROP is a computer program that provides thermophysical properties of pure fluids and mixtures over a wide range of fluid conditions including liquid, gas, and supercritical phases. It contains critically evaluated mathematical models.

The methods described in the Examples can be exemplary methods provided in the present disclosure, and are described in present tense. The results described herein were obtained using the methods.

Comparative Example

Compression equipment capacity was determined using the maximum rated flow of the pump and the maximum pressure that the pump experiences following a general procedure. A calculation was performed for a refueling station with direct fill option using a reciprocating pump operating at a pump design flow ($\dot{m}$) of 240 kg/hr and a maximum pumping pressure (p) of 400 bar (40 MPa). A system pressure drop of 50 bar (5 MPa) was assumed above the final fill pressure of the vehicle storage tank for a vehicle of 350 bar (35 MPa) nominal fill pressure (also known as $H_{35}$). The fueling system delivers liquid hydrogen from a cryogenic storage tank at pressure 1 barg containing saturated liquid with density $\rho$=67.7 kg/m3. Assuming the extend stroke of the piston is $\epsilon$=43% of the total cycle in a reciprocating pump, and the electric drive efficiency is $\eta$=70%, the instantaneous power required for the electrical motor is $$W = \frac{\dot{m}}{\rho} p / \epsilon\eta = 130.9 \text{ (kW)}.$$

There is no reference to how large the vehicle storage size is, and how long the refueling session is desired to be. For comparison purposes, it was assumed that a vehicle with a storage tank of 1200 liters is used, and 26.7 kg of hydrogen is added to the vehicle. Thus, the fill time is 6.7 minutes. The electrical supply to this refueling system needs to be sized to accommodate this high level of power needed.

Example 1. Filling an Empty Tank

For a practical refueling station, fuel cell electrical vehicles may have a range of storage sizes and they may come to the refueling station at different states of charge (SOC), which are defined as the ratio of actual density in the vehicle storage tank to that at 350 bar (35 MPa) and 15° C.

In Example 1, it was assumed that the capacity of the largest vehicle storage tank to be filled is 1200 liters, the tank is filled nominally to 350 bar, and the vehicle comes to the station at 5 bar (0.5 MPa) in its storage tank (SOC at ~2%). The desired final SOC is 95%, which allows 26.7 kg of hydrogen to be added. The desired fill time is set to 6.7 minutes to be consistent with the Comparative Example. A detailed transient simulation was carried out using an exemplary method provided in the present disclosure. The exemplary method comprises the following steps:

At time t=0, with measured initial tank pressure (p) and initial tank temperature (T=300K), the tank density (d), which is the initial density of $H_2$ in the tank, is calculated using the equation of state. For ideal gas, for example, $\rho=pM/RT$ where R is the universal gas constant, and M is the molecular weight. For hydrogen under high pressure, ideal gas equation of state is inappropriate, and the equation of state explicit in Helmholtz energy, the modified Benedict-Webb-Rubin equation of state, or the extend corresponding states as implemented in the REFPROP thermodynamic database package is used. Together with known tank size (V), Together with known tank size (V), initial tank mass ($m=\rho V$), and internal energy (u) are calculated. The initial tank mass internal energy is calculated using the equation $u=\int c_v(T,p)dT$.

2. An average pressure ramp rate (APRR) rate is defined based on initial vehicle storage tank pressure, target fill pressure, and fill time. The initial vehicle storage tank pressure used was 5 bar (0.5 MPa), and the fill time used was 6.7 minutes in Example 1. An average pressure ramp rate (APRR) rate is defined based on initial vehicle storage tank pressure ($p_0$=5 bar), target fill pressure $p_t$, and fill time ($\Delta t$=6.7 minutes), $APRR=(p_t-p_0)/\Delta t$.

3. A desired fill temperature at the nozzle ($T_n$) is set to be a suitable temperature, for example, −40° C. in Example 1.

4. The pressure drop ($\Delta p$) across the dispenser regulator to be in a suitable range, for example, 50 bar (5 MPa) in Example 1, is assumed to be consistent with that in the Comparative Example. Vaporization and heat loss across piping are not directly relevant to the electrical load determination. Thus the pumping pressure ($P_p$) is modeled to be a fixed value (50 bar) above the fill pressure ($P_p=P_n+\Delta p$).

5. The enthalpy of hydrogen at the nozzle (hz) is calculated based on the nozzle temperature and the pumping pressure, using the equation $h_z=\int c_p(T,p)dT$. By using the pumping pressure, this state is just upstream of the regulator, and the isenthalpic throttling process for the 50 bar pressure drop was implicitly included.

6. The modeling or calculation is then advanced to the next time step $\Delta t$.

7. The pressure at the vehicle storage tank (p) is $p+APRR*\Delta t$. A mass change $\Delta m$ is estimated so that now the mass in the vehicle storage tank (m) is $m+\Delta m$. By energy balance, the internal energy of the vehicle storage tank (u) is $u+hz*[1+(u/hz-1)*Qloss]$, where Qloss is a heat loss factor. When Qloss is set to 0, the fueling process is adiabatic. When Qloss is set to 1.0, the fueling process is isothermal. The heat loss is not necessarily a linear function of this factor. Qloss is set to 90% to match the observation that H35 filling with no precooling would not exceed 85° C. in the vehicle storage tank. The gaseous hydrogen fuel is dispensed in a compressed gas. Sometimes the vehicle storage tank experiences heating because of the compression. In some embodiments, precooling of the gaseous fuel may be used.

8. The vehicle storage tank temperature and density are calculated based on the updated pressure and internal energy.

9. The mass in the vehicle storage tank is calculated based on the calculated density and tank volume. The mass change $\Delta m$ is iterated until this calculated mass matches that of step 7.

10. The peak power, SOC, and other parameters as desired are evaluated.

11. The time is advanced by $\Delta t$ and repeat steps 7 through 10 until SOC and fill time targets are achieved.

Figure 6:
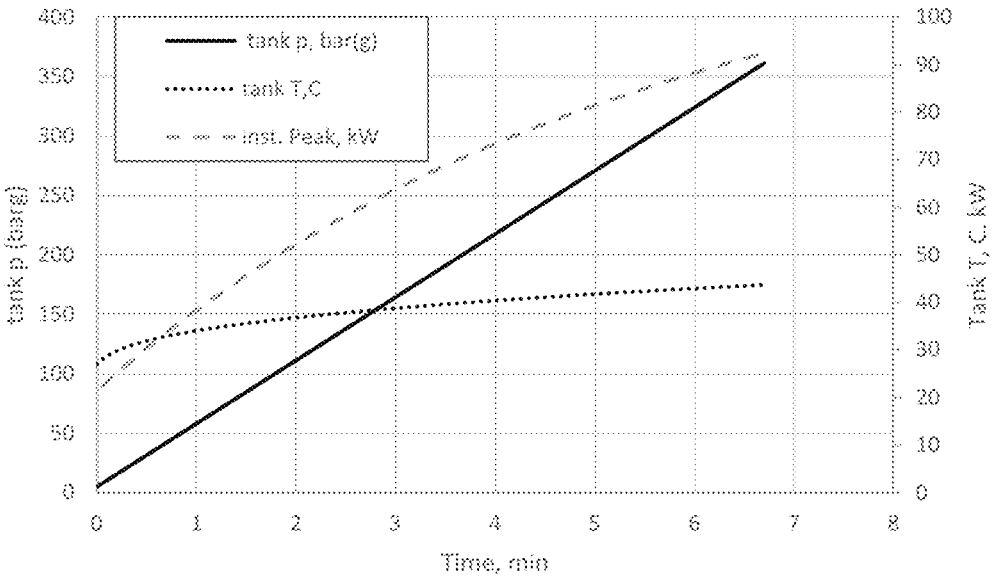
FIG. 6 shows vehicle tank pressure, vehicle tank temperature, and instantaneous motor power demand versus filling time when an empty tank is filled using an exemplary method in accordance with some embodiments.
Figure 7:
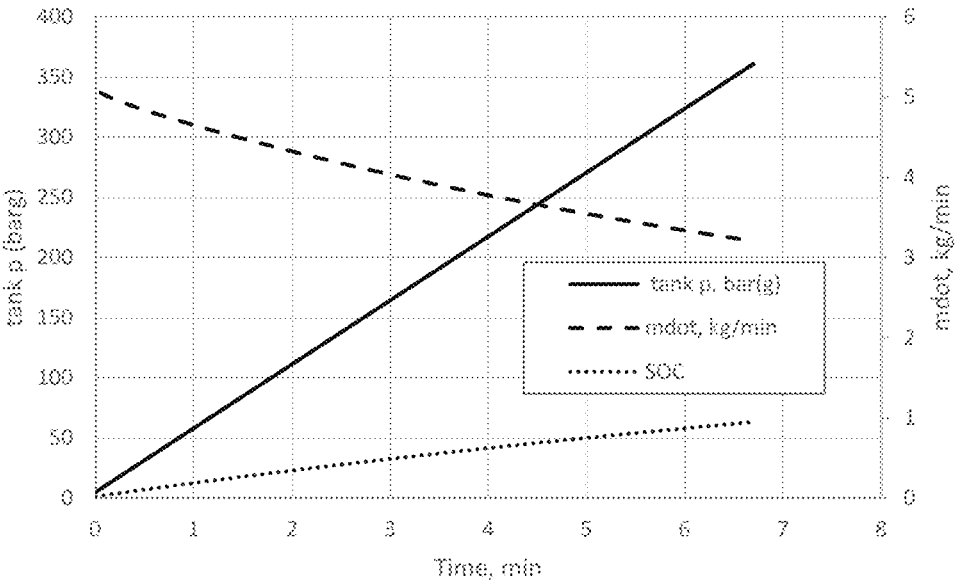
FIG. 7 shows vehicle tank pressure, filling rate, and state of charge (SOC) versus filling time when an empty tank is filled using the exemplary method as in FIG. 6.

The calculated peak power draw with $\epsilon$=43% and $\eta$=70% is 92.4 kW, which is only 71% of demand value as determined by the prior art method in Comparative Example. The final pressure in the vehicle storage tank is 361 bar, and the temperature is 43.7° C. (with fuel precooled to −40° C.). The vehicle tank pressure, temperature, and instantaneous motor power demand are shown in FIG. 6. The peak power demand occurs at the end of the fill when the pump is pushing against the maximum resistance. Vehicle tank pressure, total mass, and SOC at different filling time intervals are shown in FIG. 7. It is clear that peak mass flow occurs at the beginning of the fill when the vehicle tank pressure is the lowest, while mass flow is the lowest when the vehicle tank pressure is the highest at the end of the fill. In Example 1, when an empty tank is filled by controlling a linear increase in the pump pressure, the peak mass flow and the peak pressure do not coincide. This is desired that the use of a reciprocating pump provides such results.

Example 2. Filling a Partially Full Tank

The same calculation procedure in Example 1 was repeated for a vehicle initial pressure of 50 bar (initial SOC 17%), holding all other parameters the same as above.

Based on the calculation, the final vehicle storage tank pressure is 354 bar, the maximum temperature is 38.2° C., and the peak motor power demand is 79.3 kW. 22.5 kg of hydrogen was filled.

Example 3. Faster Fill (The calculation procedure in Example 1 was repeated with the same parameters of Example 1 except making the fill time as 5 minutes. The same calculation procedure results in peak motor power demand 123.8 kW. Peak mass flow is now 406 kg/hr, much higher than the pump rating.

Example 4. Fill with No Precooling

Using the same calculation procedure and all parameters the same as those in Example 1 except the fuel temperature 25° C., the calculation was performed. The calculation results in peak motor power demand 98.2 kW. The final vehicle storage tank pressure is 394 bar (39.4 MPa), and the temperature is 71.3° C.

Example 5. Faster Flow During Initial Part of the Fill

Figure 8:
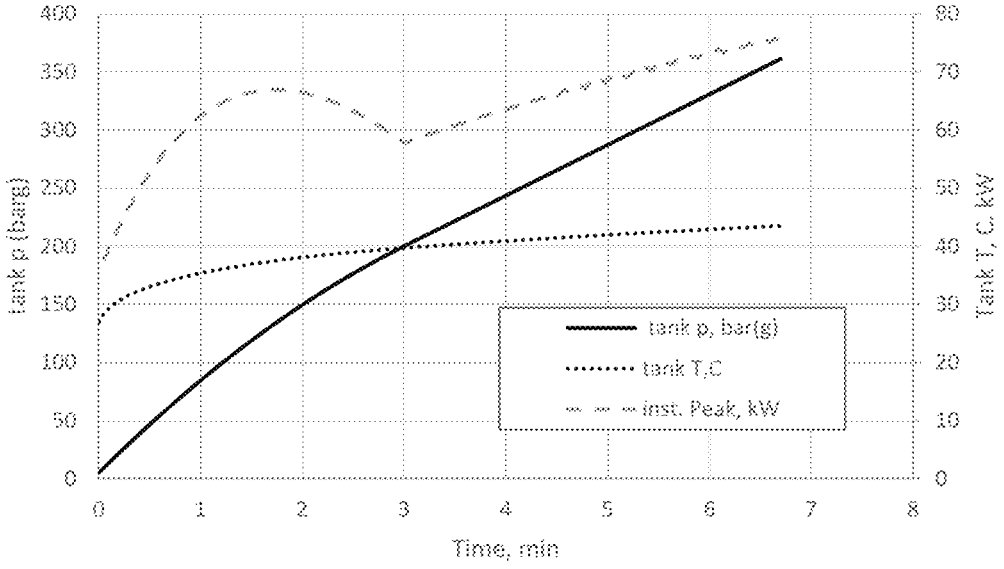
FIG. 8 shows vehicle tank pressure, temperature, and instantaneous motor power demand versus filling time using an exemplary method comprising fast filling mass flow within a first period of time in accordance with some embodiments.
Figure 9:
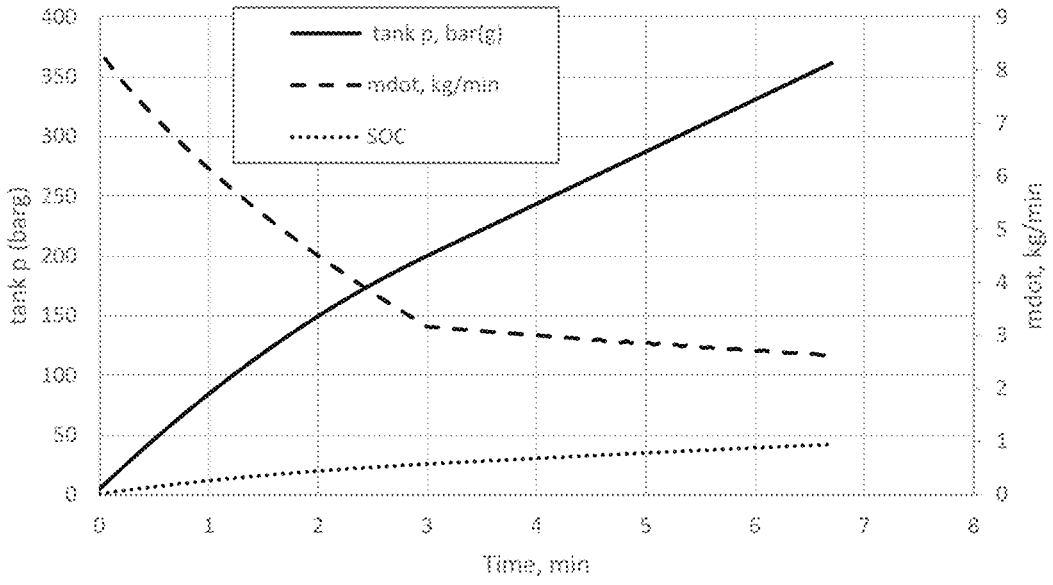
FIG. 9 shows vehicle tank pressure, filling rate, and state of charge (SOC) versus filling time using the exemplary method as in FIG. 8.

Starting with Example 1, the mass flow rate is increased for the first period of time (e.g., r minutes) of the fill by increasing the pressure ramp rate. The maximum ramp rate multiplier is set to be λ. The ramp rate multiplier is $f=\lambda+(1-\lambda)t/\tau$ for a simple linearly decreasing control algorithm. When the first period of time (τ) is 3 minutes, the maximum ramp rate multiplier (λ) is set to be 2, then the peak motor power demand becomes 76.1 kW. The final vehicle tank pressure is 361 bar, and the temperature is 43.5° C. The peak mass flow rate is now 493 kg/hr. The vehicle tank pressure, temperature, and instantaneous motor power demand are shown in FIG. 8. Vehicle tank pressure, total mass, and SOC at different filling time intervals are shown in FIG. 9. As shown in FIG. 8, the maximum ramp rate multiplier cannot be increased much further as it produces a local maximum in the power curve. That value is now 66.9 kW. Fast initial flow for the initial part of fill results in lower motor power demand. More nuanced control algorithms can be devised to flatten the power curve and reduce the peak power demand further. In Example 5, when the fast initial filling method is used, the peak mass flow and the peak pressure do not coincide. Fast initial fill reduces mass flow and power at high pressure. These results are also desired in some embodiments.

The first period of time can be pre-determined before calculation. Repeated calculation can be done by selecting different first period of time. The optimal first period of time can be then determined. The method of Example 5 is preferred in some embodiments.

The results of Examples 1-5 and Comparative Example are compared in Table 1.

TABLE 1

| Parameter | Unit | Comparative example prior art | Example 1 empty tank | Example 2 partial full | Example 3 faster fill | Example 4 no precool | Example 5 faster initial fill λ= 2 |
|---|---|---|---|---|---|---|---|
| Initial vehicle tank Pressure | bar | 5 | 5 | 50 | 5 | 5 | 5 |
| Initial vehicle tank temperature | K | n/a | 300 | 300 | 300 | 300 | 300 |
| Fill time | min | 6.7 | 6.7 | 6.7 | 5 | 6.7 | 6.7 |
| Fuel temperature at nozzle | ° C. | n/a | −40 | −40 | −40 | 25 | −40 |
| Final SOC | | 95% | 95% | 95% | 95% | 95% | 95% |
| Final vehicle tank pressure | bar (g) | 400 | 361 | 354 | 361 | 394 | 361 |
| Final vehicle tank temperature | ° C. | n/a | 43.7 | 38.2 | 43.7 | 71.3 | 43.5 |
| Max instantaneous fuel flow | kg/h | 240 | 303 | 245 | 406 | 322 | 493 |
| Total $H_2$ added | kg | 26.7 | 26.7 | 22.5 | 26.7 | 26.7 | 26.7 |
| Peak (instantaneous) motor power demand | kW | 130.9 | 92.4 | 79.3 | 123.8 | 98.2 | 76.1 |

The motor power demand in the examples, even with no precooling or faster fill, is lower than that of the Comparative Example, and does not get to the high level as determined in existing technologies. Furthermore, increasing fueling rates at the beginning of the fill when vehicle storage tank pressure is low reduces the peak motor power demand. The method using a control strategy as illustrated in Example 4 further reduces the power demand by 18%, relative to Example 1.

The methods and system described herein may be at least partially embodied in the form of computer-implemented processes and apparatus for practicing those processes. The disclosed methods may also be at least partially embodied in the form of tangible, non-transient machine readable storage media encoded with computer program code. The media may include, for example, RAMs, ROMs, CD-ROMs, DVD-ROMs, BD-ROMs, hard disk drives, flash memories, or any other non-transient machine-readable storage medium, or any combination of these mediums, wherein, when the computer program code is loaded into and executed by a computer, the computer becomes an apparatus for practicing the method. The methods may also be at least partially embodied in the form of a computer into which computer program code is loaded and/or executed, such that, the computer becomes an apparatus for practicing the methods. When implemented on a general-purpose processor, the computer program code segments configure the processor to create specific logic circuits. The methods may alternatively be at least partially embodied in a digital signal processor formed of application specific integrated circuits for performing the methods. The computer or the control unit may be operated remotely using a cloud based system.

Although the subject matter has been described in terms of exemplary embodiments, it is not limited thereto. Rather, the appended claims should be construed broadly, to include other variants and embodiments, which may be made by those skilled in the art.

What is claimed is:

1. A direct fueling station, comprising:

an insulated tank configured to store a liquefied fuel comprising a liquid phase and a gaseous phase therein, wherein the liquefied fuel comprises liquid hydrogen;

a pump configured to pump out a portion of the liquefied fuel from the insulated tank;

at least a heat exchanger connected with the pump and configured to convert the portion of the liquefied fuel into a gaseous fuel;

a dispensing unit including a flow meter, a flow control device, and at least one sensor for testing pressure and/or temperature, which are connected with the heat exchanger, wherein the dispensing unit is configured to add the gaseous fuel into an onboard fuel tank in a vehicle; and a control unit comprising one or more processors and at least one tangible, non-transitory machine readable medium encoded with one or more programs to be executed by the one or more processors, to coordinate with the pump, the flow meter, the flow control device, and the at least one sensor so as to control a method of fueling the vehicle, wherein the control unit is further configured to control an electrical power demand of the station so that the electrical power demand of the station is less than that determined by the product of a rated volumetric flow rate of the pump and a rated pumping pressure adequate for a fill pressure of the vehicle.

2. The direct fueling station of claim 1, wherein the pump is a reciprocating pump.

3. The direct fueling station of claim 1, wherein the electrical power demand of the station is at least 25% less than the product of the rated volumetric flow rate of the pump and the rated pumping pressure adequate for the fill pressure of the vehicle.

4. The direct fueling station of claim 1, wherein the control unit is configured to set a pressure ramp profile or a mass flow rate profile of the gaseous fuel added to the onboard fuel tank so as to control the electrical power demand of the station.

5. The direct fueling station of claim 4, wherein the control unit is configured to output the pressure ramp profile or the mass flow rate profile for fueling a vehicle, and status information including the state of charge (SOC) during a fill process.

6. The direct fueling station of claim 4, wherein the control unit is configured to control the electrical power demand of the station by increasing the flow rate of the gaseous fuel at a beginning of a fill process at a low pressure, then reducing the flow rate near an end of the fill process at a high pressure.

7. The direct fueling station of claim 6, wherein an instantaneous power requirement is substantially constant during the fill process.

8. A method of sizing and operating a direct fueling station, comprising steps of:

providing a portion of a liquefied fuel comprising a liquid phase and a gaseous phase stored in an insulated tank in a direct fueling station, wherein the direct station further comprises a pump, at least one heat exchanger connected with the pump, and a dispensing unit including a flow meter, a flow control device, and at least one sensor for testing pressure and/or temperature, which are connected with the heat exchanger, wherein the liquefied fuel comprises liquid hydrogen;

coupling a vehicle having an onboard fuel tank with the flow control device and the at least one sensor;

converting the portion of the liquefied fuel to a gaseous fuel in the at least one heat exchanger;

adding the gaseous fuel to the onboard fuel tank in the vehicle using the dispensing unit; and determining and controlling an electrical power demand of the station using a control unit, wherein the control unit comprises one or more processors and at least one tangible, non-transitory machine readable medium encoded with one or more programs to be executed by the one or more processors, to coordinate with the pump, the flow meter, the flow control device, and the at least one sensor so that the electrical power demand of the station is less than that determined by the product of a rated volumetric flow rate of the pump and a rated pumping pressure adequate for a fill pressure of the vehicle.

9. The method of claim 8, wherein a total electrical power demand of the pump is at least 90% of the electrical power demand of the station during a filling cycle.

10. The method of claim 8, wherein the pump is a reciprocating pump.

11. The method of claim 8, wherein the electrical power demand of the station is at least 25% less than the product of the rated volumetric flow rate of the pump and the rated pumping pressure adequate for the fill pressure of the vehicle.

12. The method of claim 8, wherein the electrical power demand of the station is determined and controlled by setting up a pressure ramp profile or a mass flow rate profile of the gaseous fuel added to the onboard fuel tank.

13. The method of claim 12, wherein the electrical power demand of the station is determined and controlled by increasing the flow rate of the gaseous fuel at a beginning of a fill process at a low pressure, then reducing the flow rate near an end of the fill process at a high pressure.

14. The method of claim 13, wherein an instantaneous power requirement is substantially constant during the fill process.

15. The method of claim 12, wherein the step of determining and controlling the electrical power demand of the station using the control unit comprises steps of:

inputting initial tank pressure, initial tank temperature, volume of the insulated tank, a desired fill time, a target pressure or a target state of charge (SOC);

calculating initial density, total mass, and internal energy of the liquefied fuel in the onboard fuel tank;

setting a pressure ramp profile to achieve the targeted fill time;

setting a desired fill temperature at a nozzle;

setting the pump discharge pressure sufficiently high to overcome a system pressure loss from pump discharge to the nozzle to achieve a desired nozzle pressure;

calculating enthalpy of the gaseous fuel based on the desired fill temperature at the nozzle and the pump discharge pressure;

advancing a time interval;

applying mass and energy balance to the onboard fuel tank after the time interval is advanced, optionally with consideration of a heat loss;

determining an added mass of the gaseous fuel added into the onboard fuel tank; and evaluating an instantaneous electrical power demand of the station and state of charge (SOC), repeating the step of advancing a time interval if needed so as to reach the target SOC.

16. The method of claim 15, wherein the step of determining and controlling the electrical power demand of the station using the control unit further comprises adjusting the pressure ramp profile so that the electrical power demand of the station is substantially constant during the fill process, while the target fill time and target SOC are achieved.

17. The method of claim 8, wherein the electrical power demand of the station is at least 15% or 20% less than the product of the rated volumetric flow rate of the pump and the rated pumping pressure adequate for the fill pressure of the vehicle.

18. The method of claim 12, further comprising outputting the pressure ramp profile or the mass flow rate profile of the gaseous fuel on which a vehicle is refueled.

* * * * *